US006309489B1

(12) United States Patent
Fildan et al.

(10) Patent No.: US 6,309,489 B1
(45) Date of Patent: Oct. 30, 2001

(54) ADJUSTABLE STRAP FASTENER FOR BRASSIERES AND THE LIKE AND METHOD OF MAKING SAME

(75) Inventors: Gerhard Fildan, Trumau; Karl Wanzenböck, Leobersdorf, both of (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/443,082

(22) Filed: Nov. 18, 1999

(51) Int. Cl.[7] ..... B32B 31/18

(52) U.S. Cl. ..... 156/73.3; 156/73.1; 156/201; 156/251; 156/290

(58) Field of Search ..... 156/73.1, 73.3, 156/200, 201, 202, 216, 251, 290, 515, 553, 554, 580.1, 580.2

(56) References Cited

U.S. PATENT DOCUMENTS

| | | | | |
|---|---|---|---|---|
| 4,158,584 | * | 6/1979 | Clarke et al. | 156/73.1 |
| 4,161,420 | * | 7/1979 | Clarke et al. | 156/73.3 |
| 4,500,372 | * | 2/1985 | Mion | 156/73.3 |
| 5,785,806 | * | 7/1998 | Engle et al. | 156/580.2 |
| 5,944,924 | * | 8/1999 | Engle et al. | 156/73.3 |

* cited by examiner

*Primary Examiner*—James Sells
(74) *Attorney, Agent, or Firm*—Herbert Dubno

(57) ABSTRACT

An adjustable brassiere metal-free back fastener is formed by molding eyelets and studs on ultrasonically or mechanically pierced fabric tapes composed of polyamide yarn which is partly enfolded in an outer tape ultrasonically welded to the inner tape. No stitching is required in the fabrication of the fastener and because the coupling members and the thermoplastic yarn can be of the same polyamide material, the product can be uniformly dyed.

12 Claims, 12 Drawing Sheets

FIG. 26
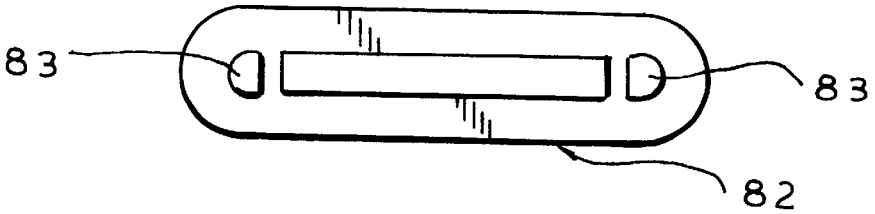
FIG. 25
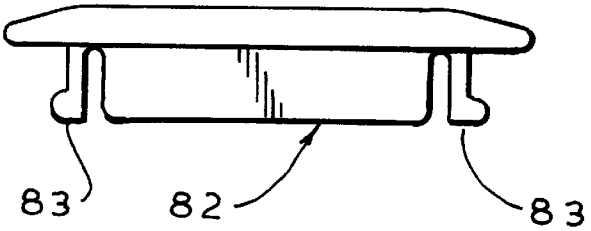
FIG. 24
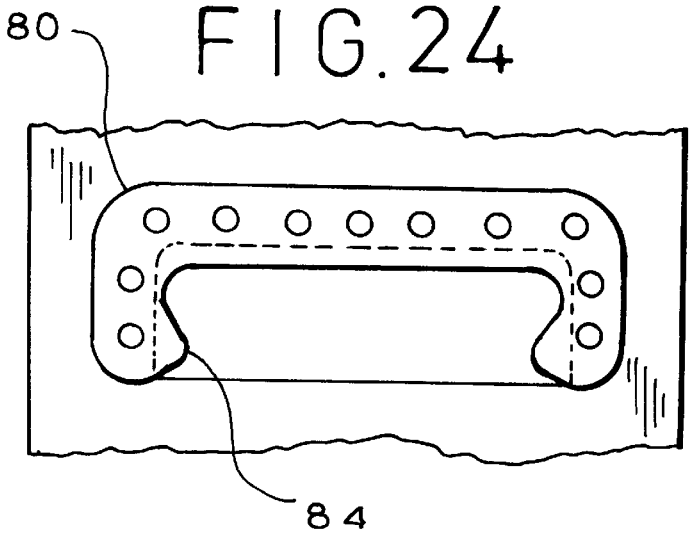
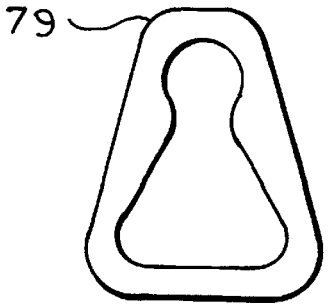
FIG. 27
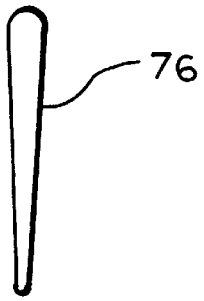
FIG. 28

ADJUSTABLE STRAP FASTENER FOR BRASSIERES AND THE LIKE AND METHOD OF MAKING SAME

FIELD OF THE INVENTION

My present invention relates to the strap fasteners of brassieres, lingerie and corsetry and particularly with so-called hook and eye strap fasteners of the type in which a fastener member on one strap can be affixed to a coupling member on another strap, usually adjustably, to secure the garment which can be a brassiere. The invention also relates to an improved method of making the new strap fastener.

BACKGROUND OF THE INVENTION

While brassiere-type fasteners for conveniently and comfortably securing the two straps at the back of a brassiere together, usually adjustably, have been provided in many configurations heretofore, perhaps the most common utilize a hook and eyelet configuration. The male member of the strap fastener can be formed by one or more hooks on one of the straps while the female member is constituted by a plurality of eyelets spaced apart in a longitudinal direction to engage with the hook selectively for adjustable fastening of the brassiere. The eyelets may be metal, or powder-coated metal. Problems have been encountered in prior constructions of this type with respect to the uniform dying of the product since the tape was frequently provided with a lining or cover member by stitching and the tapes, the lining, the threads used for attaching coupling members or joining the lining to the tape, etc. all tended to dye differently. This applies also to the coupling members themselves. When the prior-art tape was fed to the strap fabric and cut parallel to the longitudinal dimension of the strap by ultrasonic means, a sharp edge was formed which was uncomfortable or injurious.

It has thus been long sought in the brassiere, corsetry and lingerie field to be able to provide a strap fastener or brassiere-type closure which would not snag on other garments, which would not be damaged in the wash, which would be comfortable for the wearer, which could be dyed uniformly and preferably with the same dying characteristics as the garment and which would be simple to fasten and unfasten, especially since the fastener is often provided at the back of the wearer.

OBJECTS OF THE INVENTION

It is, therefore, the principal object of the present invention to provide an improved strap fastener, especially for brassieres but also suitable for garment closures of other types, e.g. for lingerie and corsetry, whereby these desiderata will be satisfied.

Another object of this invention is to provide an improved metal-free strap fastener for the purposes described which will be free from drawbacks characterizing earlier strap fasteners.

A further object of the invention is to provide an improved method of making a strap fastener which can be less expensive and more efficient than earlier systems, requiring the use of simpler equipment and less skilled labor.

SUMMARY OF THE INVENTION

According to the present invention, these objects are attained by fabricating a coupling half of the strap fastener with an inner or first web or tape of a woven or tricot knit fabric (or a woven fabric having a tricot knit facing layer) composed of thermoplastic yarn and bonding that tape or web to a second tape or web into which the first tape or web is at least partly enfolded, by ultrasonic seaming along the longitudinal edges of the tape and by providing the inner tape with its coupling member by a molding operation so that, in the construction of this fastener half, no stitching is required.

The application of the coupling members, which can be eyelets lining holes formed in the first tape by ultrasonic punching techniques, and the assembly of the two tapes together, as well as the severing of a length forming the fastener half form the continuous webs which are used to produce the successive lengths can all be effected by ultrasonic means so that no stitching is required, except, possibly, for attaching the fastener strip to the garment.

When all of the webs used are woven tapes or tricot knits (or layers of woven and knit tapes) of say a polyamide (nylon) yarn and the molded coupling members are themselves composed of polyamide (e.g. a nylon) all of the elements of the fastener have substantially identical dying characteristics and can be dyed with the garment without any significant difference being visible between the garment and the fastener.

The second web or tape into which the first tape is enfolded covers the eyelets from the back and thus provides a cushion against the skin of the wearer and, if desired, a further tape or strip, preferably also of a tricot knit fabric, can be inserted between the second web and the first if desired.

According to a feature of the invention, the first and second webs are longitudinally seamed at spaced apart locations by the ultrasonic welding, leaving turned over flaps of the fastener strip beneath which a portion of the garment can be inserted for attachment of the strip to the garment, e.g. also by ultrasonic seaming or, as is less preferred, by stitching.

The method of making a strap fastener for articles of clothing including brassieres, lingerie and corsetry, thus can comprise the steps of:

(a) molding onto a first elongated knit web of a thermoplastic yarn, a succession of eyelets to form a female-fastener strip;

(b) enfolding the female-fastener strip in a second elongated knit web of a thermoplastic yarn so that edge portions of the second web overlie one face of the female-fastener strip alongside the succession of eyelets and another portion of the second web covers the other face of the female-fastener strip;

(c) ultrasonically joining the edge portions to the female-fastener strip and the female-fastener strip to the other portion of the second web at longitudinally spaced-apart intervals along the female-fastener strip at which the eyelets are located to form a fastener band; and (d) ultrasonically severing successive lengths from the band, each of the lengths including at least one of the eyelets whereby the lengths can be affixed to a garment for engagement of a male fastener in the respective eyelet to secure the garment.

As noted, the first web can be ultrasonically or mechanically pierced to form a succession of holes and the eyelets can be molded onto the first web around the holes. Of course, coupling members other than eyelets can be used although they are not preferred. The studs are also molded to the tape. Such coupling members can be hook and loop type fasteners, for example.

The webs can also be ultrasonically joined together along an end of the length formed by ultrasonically severing the lengths from the band.

The eyelets are preferably molded onto the first web in a succession of spaced apart groups of at least three eyelets per group.

The male fastener can comprise a hook molded onto a tape composed of thermoplastic yarn, preferably a woven polyamide. According to a feature of the invention, a succession of the hooks is molded onto the tape of the male fastener and the tape of the male fastener is severed ultrasonically between the hooks into respective male fastener lengths which are secured to the garment, the hooks, the eyelets and the webs and the tape being all composed of polyamide.

The strap fastener itself can comprise:

(a) a first elongated fabric web of a thermoplastic yarn having at least one coupling member molded onto the first fabric web;

(b) a second elongated fabric web of a thermoplastic yarn into which the first fabric web is enfolded and having a pair of edge portions of the second web overlying one face of the first fabric web at opposite sides of the coupling member, and another portion of the second fabric web covering the other face of the first fabric web;

(c) a pair of ultrasonic welding seams along opposite longitudinal edges of the webs joining the edge portion of the second fabric web to the first fabric web and the first fabric web to the other portion to form one coupling tape; and (d) a third elongated fabric web of a thermoplastic yarn having another coupling member molded onto the third web and engageable with the one coupling member, the third web and the other coupling member forming another coupling tape, the coupling tapes being attachable to respective parts of a garment to be held together by the engagement of the coupling members of the tapes.

According to another aspect of the invention, the coupling members which are applied to the fabric tape are male and female members forming a press button which can be joined by pressing the male member into the female member.

According to another feature of this aspect of the invention, the female member is open laterally through a constriction and the male member can be slid transversely into engagement with the female member to connect the members together. Separation can be effected by pulling the male and female members apart or by sliding the male member out of the female member in a direction opposite to that in which the male member was inserted.

When a row of male members on one strap end and a row of female members on the other strap end form the back fastener of the brassiere, a high degree of flexibility is ensured by reason of the separation of the male and female members along the respective row.

In an important aspect of the invention, the continuous tape carrying the members may have rolled over edges which are ultrasonically seamed except at locations at which the rolled over edges are to be opened at least to a limited degree to insert the respective straps which then can be ultrasonically seamed to the tape.

The tape is cut transversely and runs in the direction of the longitudinal edges so that, upon cutting, rounded corners can be formed to protect the wearer against injury from sharp corner edges.

The fasteners of the invention are substantially thinner than metal hook and eyes or metal snap tapes.

BRIEF DESCRIPTION OF THE DRAWING

The above and other objects, features, and advantages will become more readily apparent from the following description, reference being made to the accompanying drawing in which:

FIG. 24 is a view similar to FIGS. 22 and 23 of an elongated female fastener member;

FIG. 25 is a side view of the male member cooperating with that female member;

FIG. 26 is a plan view of the male member of that fastener;

FIG. 27 is a view similar to FIG. 22 of another embodiment;

FIG. 28 is a diagram showing the taper of the thickness of the latter female member;

SPECIFIC DESCRIPTION

Figure 1:
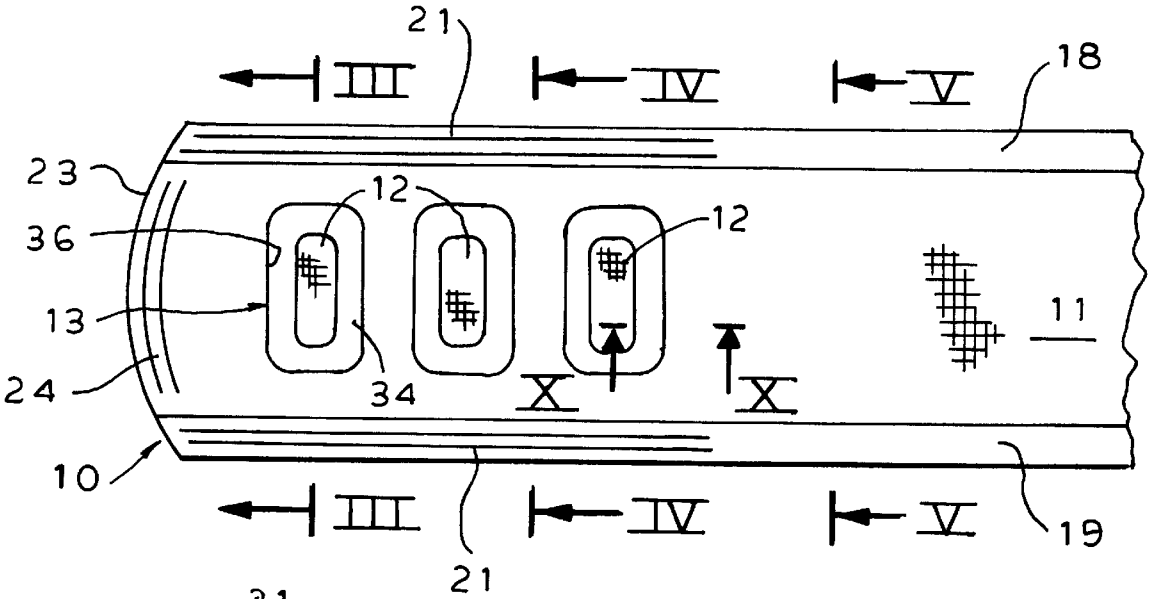
FIG. 1 is a somewhat diagrammatic elevational view of a female fastener half for a strap fastener according to the invention.
Figure 2:
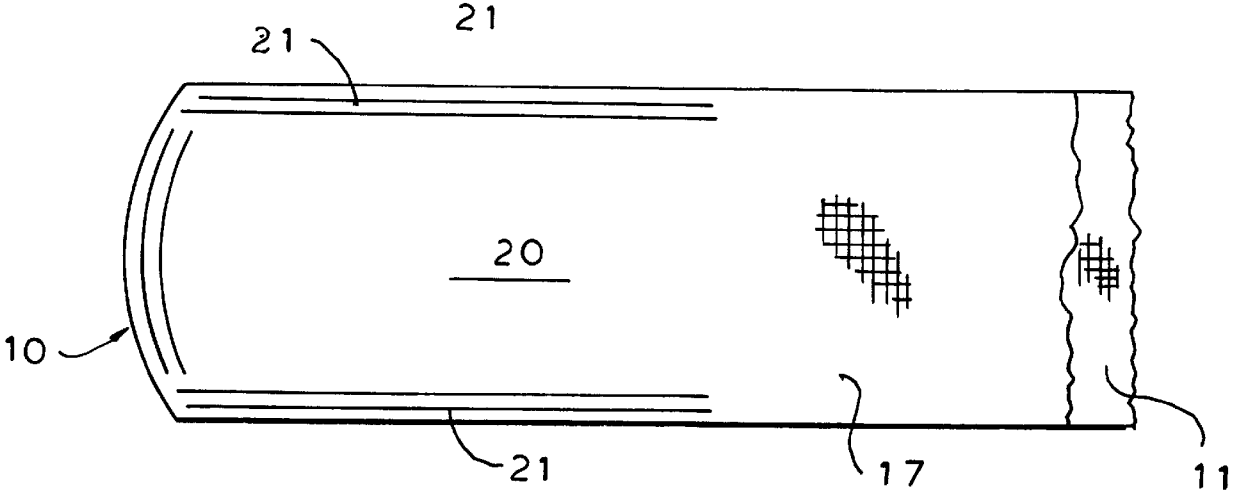
FIG. 2 is a view similar to FIG. 1 of the reverse side.
Figure 3:
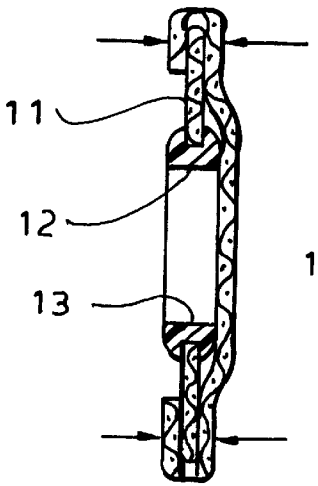
FIG. 3 is a cross sectional view taken along the line III—III OF FIG. 1.
Figure 10:
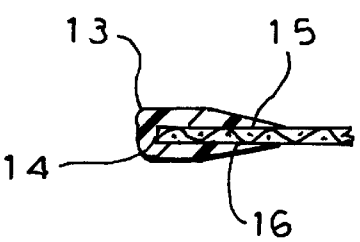
FIG. 10 is a cross sectional view drawn to a larger scale taken along line X—X of FIG. 1.

As can be seen from FIGS. 1 and 2, the strap fastener of the present invention comprises a female fastener half generally represented at 10 and having a first web or strip 11 of a tricot knit or woven polyamide (nylon) in which are ultrasonically or mechanically pierced, elongated holes 12 shown here to be three in number in a group and along the margins of each of which a frame or eyelet 13 is injection molded. The eyelet 13 is composed of a the same polyamide as constitutes the yarn from which the web 11 is fabricated. As can be seen from FIG. 10, the eyelet 13 surrounds the edge 14 of the hole and continues onto the flanks or faces 15 and 16 of the first web. The first web 11 is, in turn, partly enfolded in a second web or tape 17, also of a tricot knit of polyamide yarn which has a pair of edge portions 18 and 19 bent over onto the face 15 of the first web 11 and a further portion 20 covering the reverse face 16 of the web 11 (see FIGS. 3–5).

Figure 5:
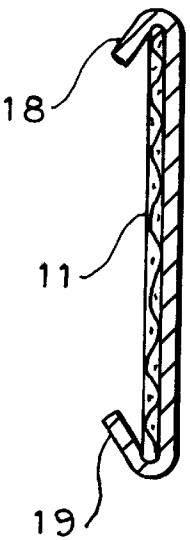
FIG. 5 is a cross sectional view taken along the line V—V of FIG. 1.
Figure 4:
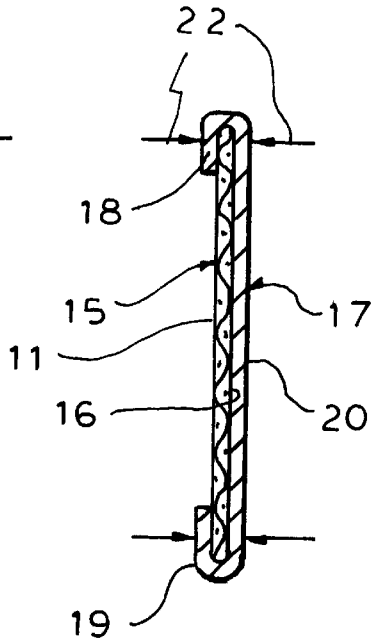
FIG. 4 is a cross sectional view taken along the line IV—IV of FIG. 1.

In the region of the group of eyelets 13, the bent over portions 18 and 19 are ultrasonically welded to the face 15 of the first web 11 and the first web 11 is welded to the web 17, the ultrasonically welding being represented at 21 by the light lines there shown and by the arrows 22 visible in FIG. 4, for example, Beyond the ultrasonic weld seams 21, the inwardly bent portions 18 and 19 form flaps as shown in FIG. 5 into which the edges of the garment can be inserted so that, by a further ultrasonic welding or by stitching, the strips shown at 10 in FIG. 1 and 2 can be fixed to the garment. The end of the strip 10 is rounded at 23 and can be formed with a further ultrasonic weld seam as represented at 24 to bond the two webs together.

As a comparison of FIGS. 1 and 2 will show, the portion 20 covers the eyelets 13 at the back of the strip to provide a protective layer between these eyelets and the skin of the user.

Figure 7:
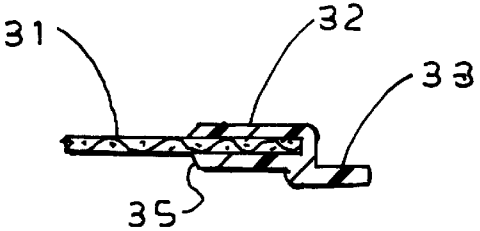
FIG. 7 is a cross sectional view taken along the line VII—VII of FIG. 6.
Figure 6:
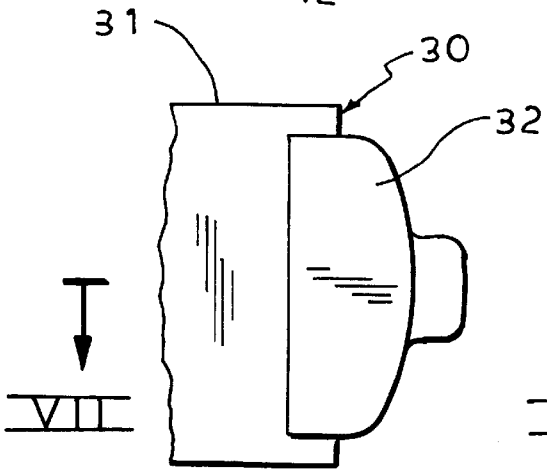
FIG. 6 is a view similar to FIG. 1 showing a portion of the male half of the strap fastener.

The male strip 30 comprises a tricot knit web 31 onto which the coupling member 32 is molded, the coupling member 32 (FIGS. 6 and 7) having a lip 33 which engages in the eyelet 13 beneath the bar 34 thereof while the shoulder 35 can snap against the bar 36 to retain the hook in the eyelet.

All of the tapes or webs described can be composed of the identical polyamide as can form the coupling members 13 and 32 so that the entire fastener has uniform dying characteristics.

Figure 8:
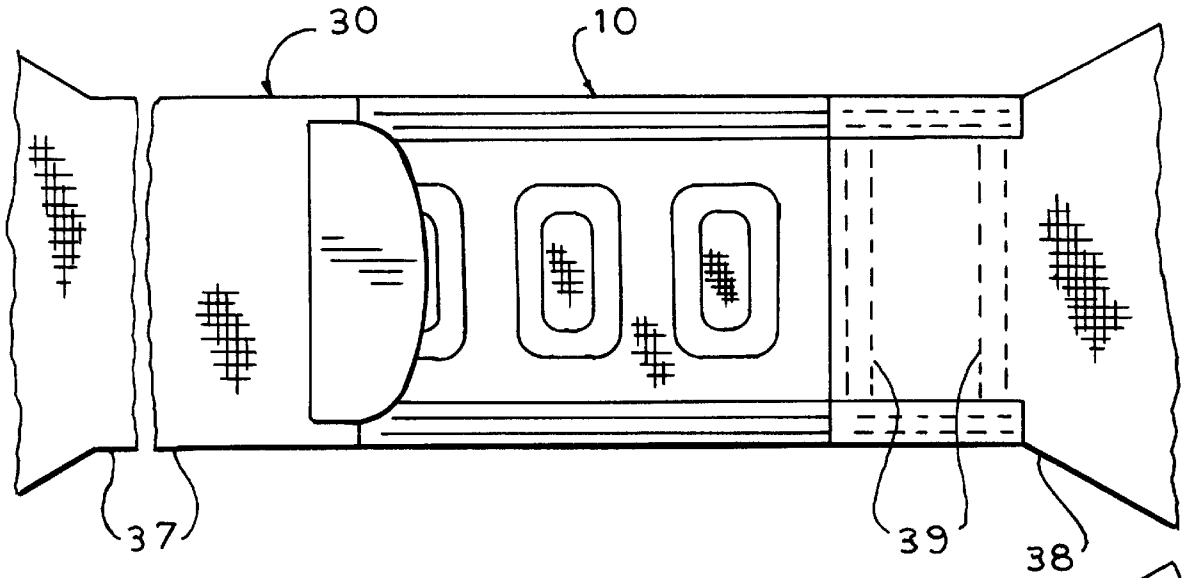
FIG. 8 is a view similar to FIG. 1 showing the complete strap fastener as formed with a closure for the back of a brassiere.
Figure 9:
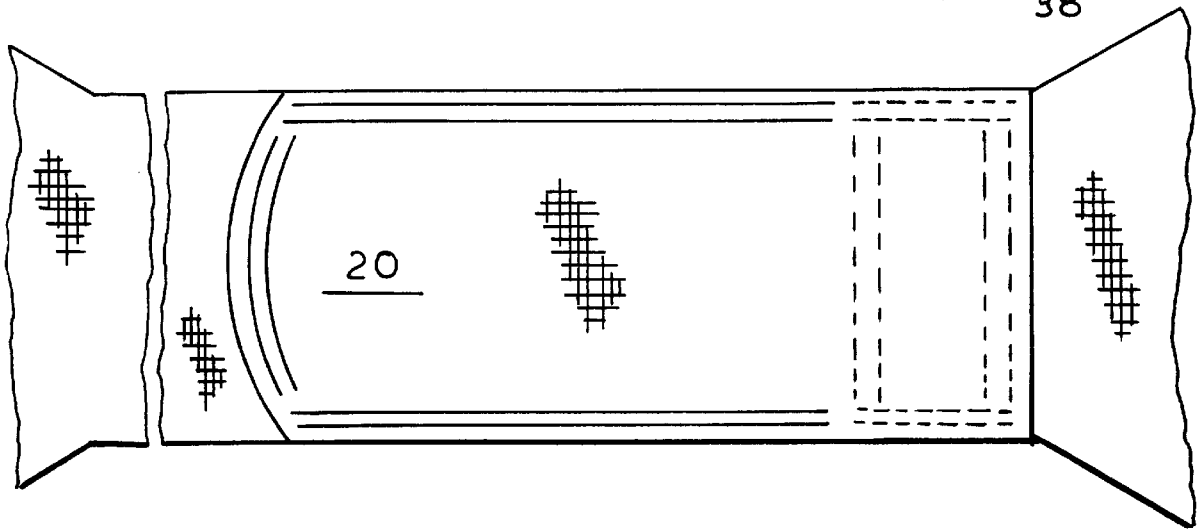
FIG. 9 is a view similar to FIG. 8 showing the reverse of the fastener, i.e. the portion of the fastener which contacts the skin of the user.

As can be seen from FIG. 8, the two coupling strips 10 and 30 can be connected to parts 37 and 38 of the garment, e.g. by stitching at 39 or by ultrasonic welding so that the two parts of the garment can be held together in the position shown in FIG. 8. From the back, the fastener has only the smooth region 20 in contact with the skin (compare FIGS. 8 and 9).

Figure 14:
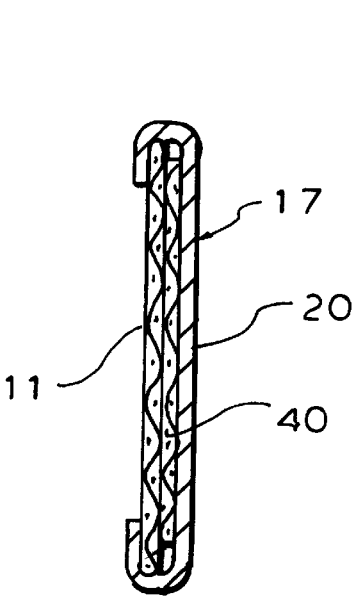
FIG. 14 is a view similar to FIG. 5 but showing the insertion of an additional cushioning tape into the fastener.

Further cushioning against the back of the user can be afforded by a further strip 40 of tricot knit tape composed of the same polyamide yarn and inserted between the first web 11 and the portion 20 of the second web 17 as seen from FIG. 14.

Figure 13:
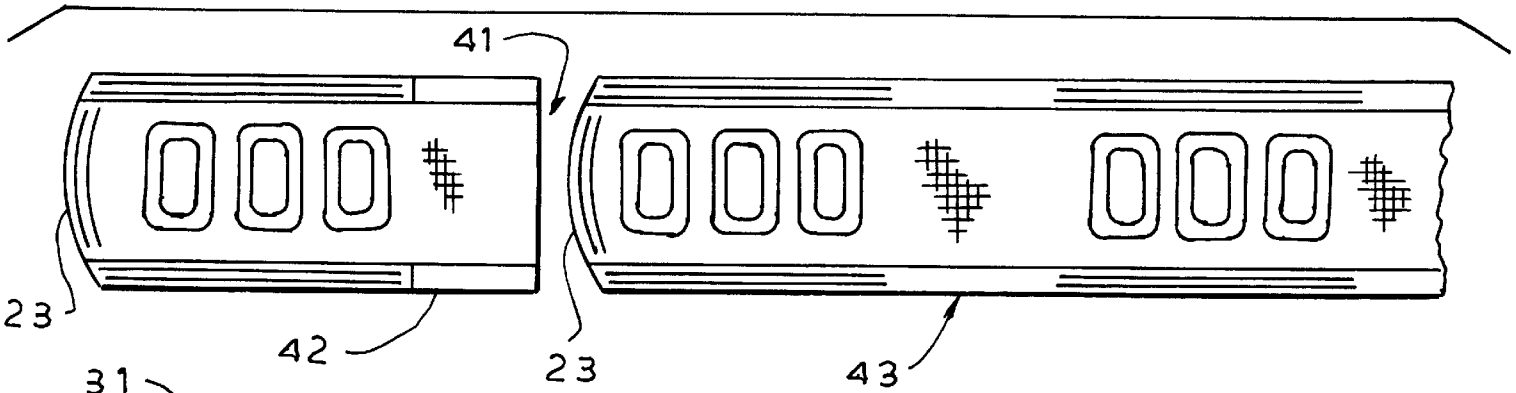
FIG. 13 is an elevational view illustrating the step of severing the length of the fastener from the continuous band.
Figure 11:
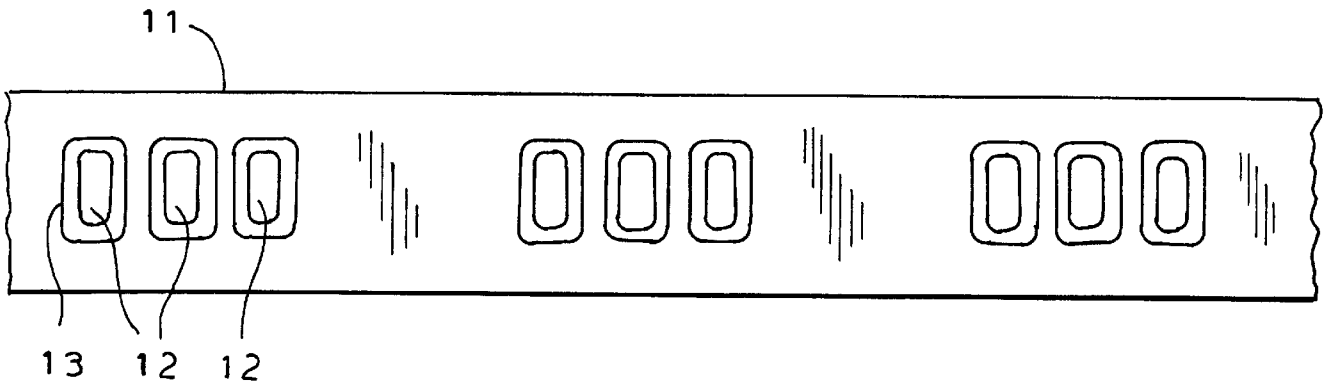
FIG. 11 is an elevational view showing the formation of the successions of eyelets on the first web according to the invention.
Figure 12:
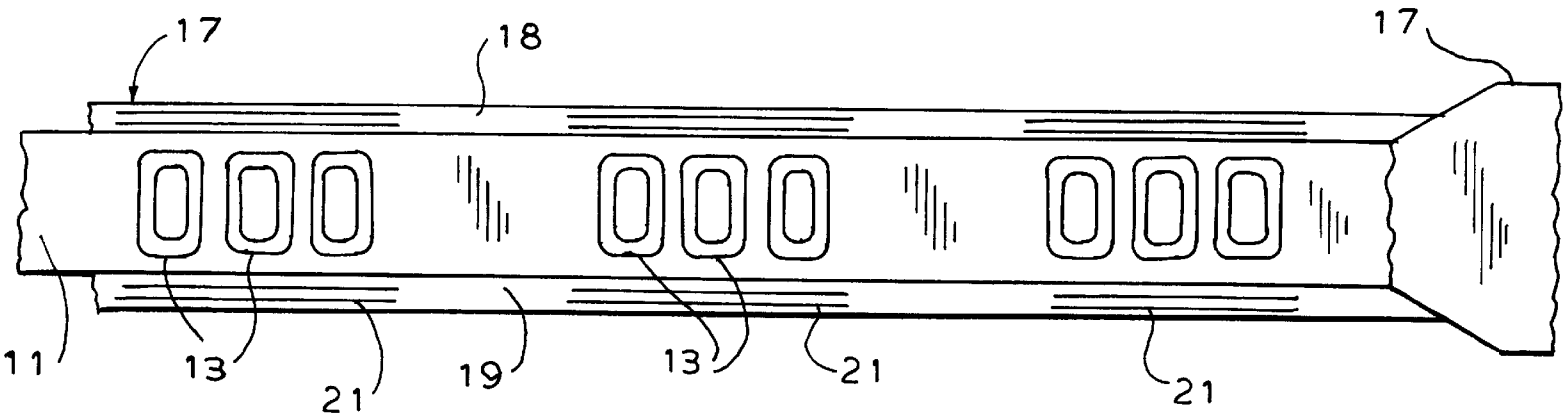
FIG. 12 illustrates the continuous band after the application of the second web thereto.

The mode of fabrication can be seen from FIG. 11 in which a band of the first web 11 is fed along a path continuously and is ultrasonically punched to produce the holes 12 in groups of three and the eyelets 13 injection molded onto the web 11 around the holes 12. Further downstream along the same path or in a separate path, the second web 17 is partially enfolded around the first web so that the portions 18 and 19 overlie the web 11 and the ultrasonic weld seams 21 are formed at spaced apart locations but in the regions of the groups of eyelets the resulting band of interconnected webs can be ultrasonically cut at 41 to sever the length 42 from the remaining band 43 and form the transverse welds 23, the lengths 42 constituting the strips 10 previously described. The step represented in FIG. 13 is further downstream along the path represented by FIG. 12.

The male coupling strips are similarly fabricated in a fabrication line and the lengths of the two strips are applied to the garments as has previously been described.

FIGS. 15–21 show a press button connector which can be provided on respective tapes carrying the male and female members, the female member being formed as an eyelet in accordance with the principles previously described.

Figure 15:
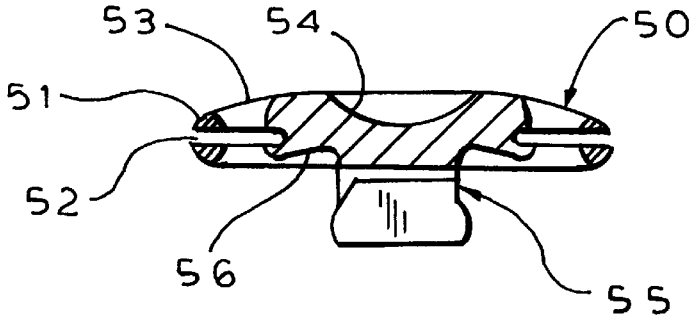
FIG. 15 is a cross sectional view of a press button which can be provided on a tape according to a feature of the invention.
Figure 16:
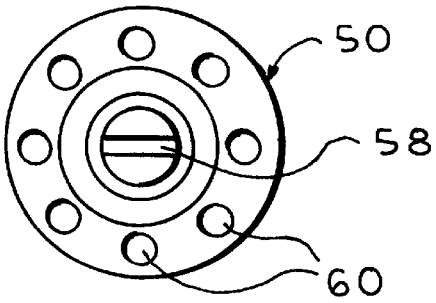
FIG. 16 is a plan view from the projection side of that male member.
Figure 17:
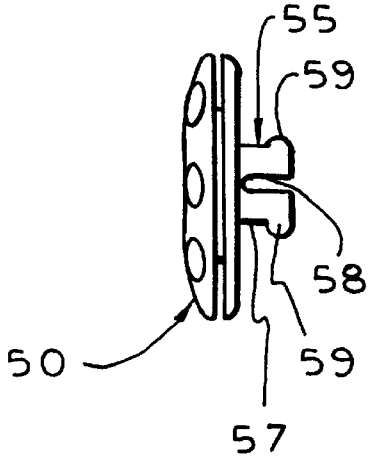
FIG. 17 is a side elevational view thereof.

As can be seen from FIGS. 15–17, the male member 50 of the press button has a head 51 formed with a slot 52 in which the tape is received and a convex surface 53 which is formed with a depression 54. On the opposite side of this head, a projection 55 is provided which is surrounded by a concave portion or recess 56 whose curvature matches the convex curvature of the female member which is described in connection with FIGS. 18–20. As can be seen from FIGS. 16 and 17, the projection 55 has a shank 57 which is split at 58 and is formed with bulges 59 at its ends circular depressions or holes 60 angularly equipspaced around the head permit molding of the fastener member on the tape with greater security.

Figure 18:
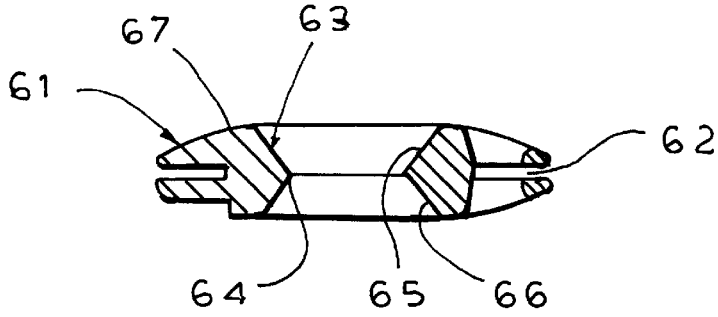
FIG. 18 is a cross sectional view through the female press bottom fastener.
Figure 19:
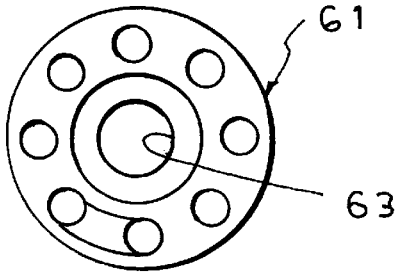
FIG. 19 is a plan view thereof.
Figure 20:
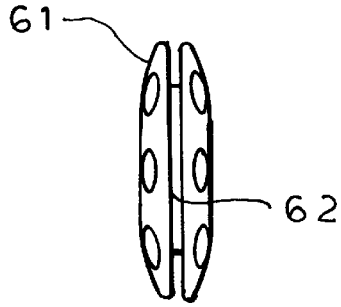
FIG. 20 is a side view of the female half of the press button.
Figure 21:
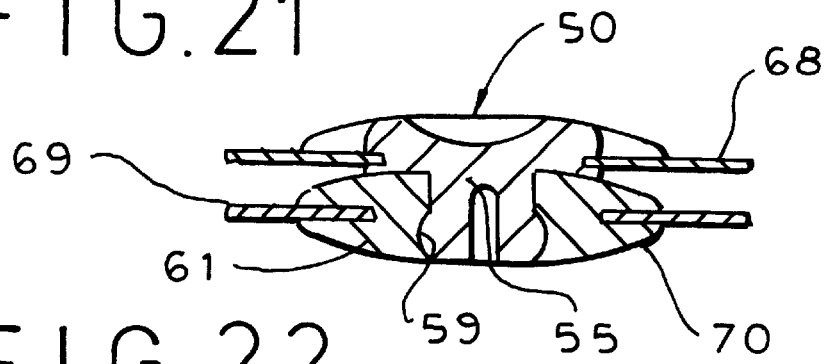
FIG. 21 is a cross sectional view showing the press button parts fitted together and on respective tapes.

As can be seen from FIGS. 18–20, the female member 61 is disk shaped and is formed with a slot 62 in which the tape is received and has a hole 63 provided with a constriction 64 past which the projection 55 can be pressed so that the bulges 59 lie on the opposite side of the constriction from that on which the head of the male fastener is located (see FIG. 21).

To facilitate insertion and removal of the projection, the hole 63 has conical convergent and divergent flanks 65 and 66 on opposite sides of the constriction 64.

The curvature of the concave portion 67 of the female member 61 matches the curvature of the concavity 56 so that the overall thickness of the assembled press button (FIG. 21) is comparatively small and substantially less than 5 mm.

The male member 50 is shown to be mounted on the tape 68 in FIG. 21 while the female member 61 is mounted on the tape 69 and the back of the fastener is additionally covered by a brushed or plush fabric strip at 70 to cushion the fastener toward the body of the user.

Figure 22:
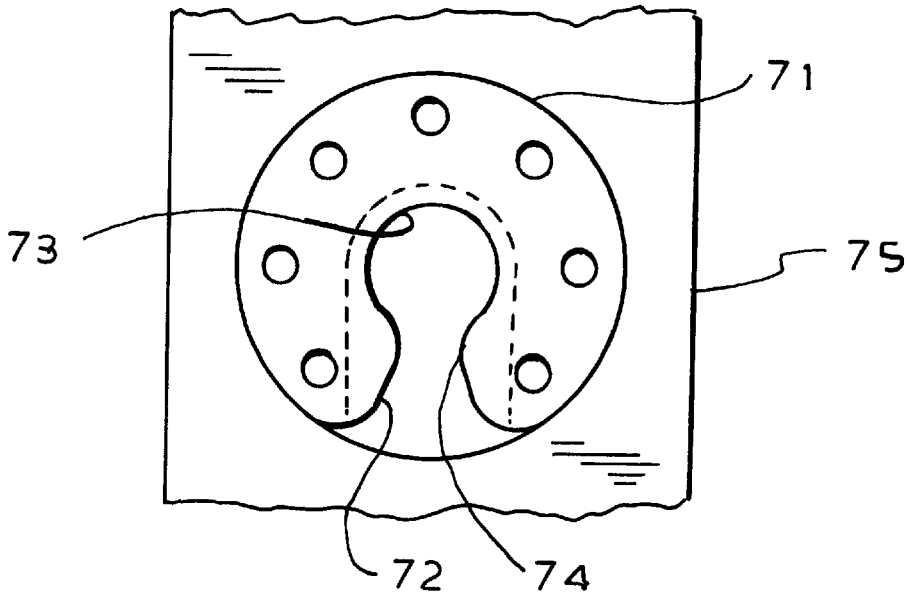
FIG. 22 is an elevational view showing a press button with a slide interfitting capability.

While the press button of FIGS. 15–21 is engaged by pressing the male member into the female member and released by pulling the members apart, the same principle can be used with a lateral engagement of the male member in the female member. In that case, the male member of the fastener may be that described in connection with FIGS. 15–17 while the female member 71 as shown in FIG. 22 has a lateral mouth 72 connected to the hole 73 by a constriction 74 passed which the projection of the male member can be pressed. The female member is formed on the tape 75 in this embodiment. Alternatively, the female member 76 can be elongated and provided with the constriction 77 passed which the projection can be forced, a funnel shaped guide 78 being provided to guide the projection into the female member. As can be seen from FIG. 28, the female member can be tapered so that the projection can be guided into the bore by feel since the user can readily discern the direction of insertion by the increased thickness in that direction.

Figure 23:
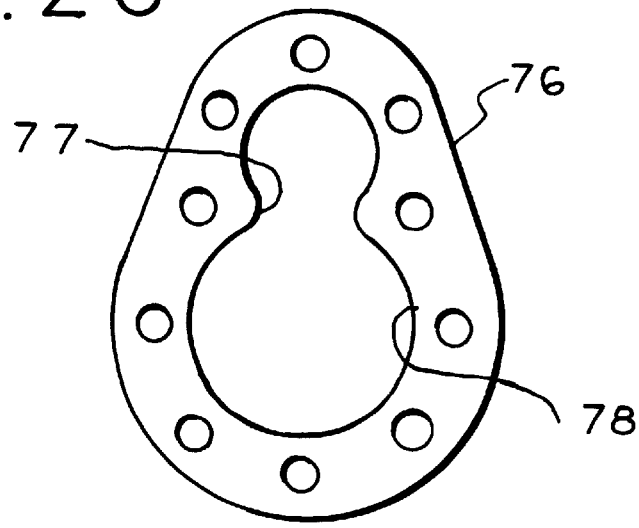
FIG. 23 is a view similar to FIG. 22 showing another embodiment.

Another configuration of the female member has been shown at 79 in FIG. 27 and operates with the same principle as that of the female member 76 of FIGS. 23 and 28.

It will be noted that a number of such female members will normally be provided in a row transversely to the tape (FIGS. 29–31) in a brassiere fastener. However, it is possible to provide a single fastener 80 on the tape 81 at each location longitudinally of the tape and in that case, the fastener may be elongated but otherwise operates in accordance with the principles described, enabling the male member 82 (FIG. 25) with its projections 83 to engage behind the constriction 84 by laterally inserting the male member in the female member. The male and female members can be pulled apart like the press button in the manner already described.

Figure 29:
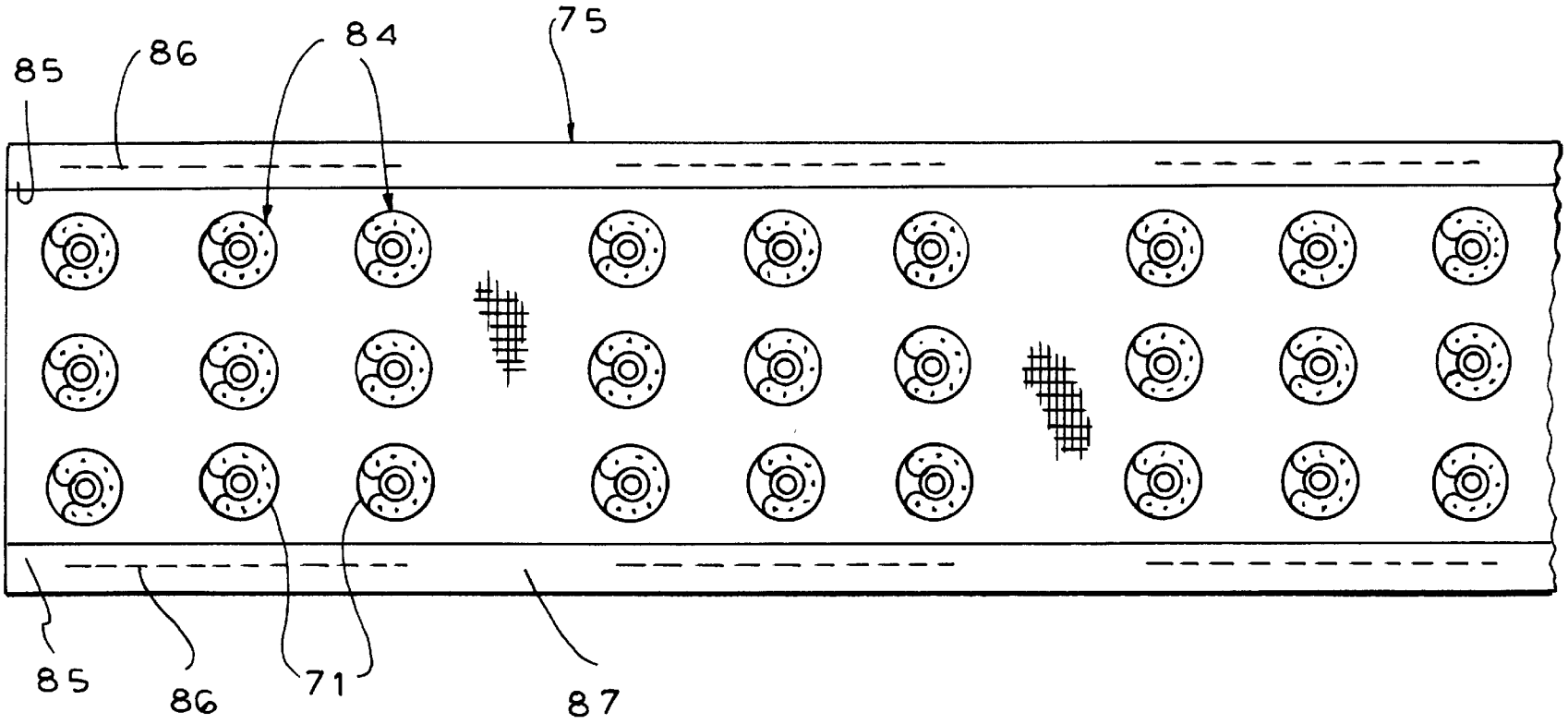
FIG. 29 is a plan view showing a tape having rows of the female member.
Figure 30:
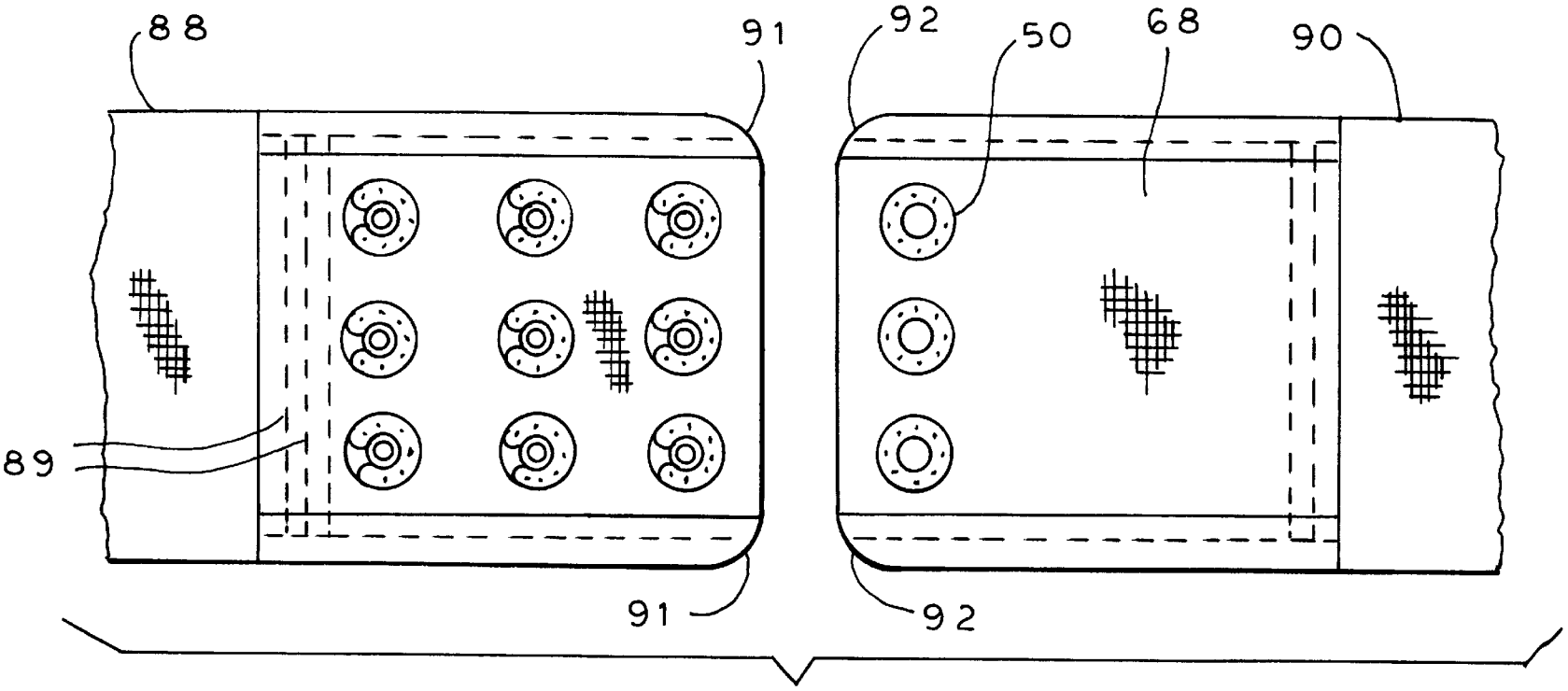
FIG. 30 shows the back fastener for a brassiere upon separation.
Figure 31:
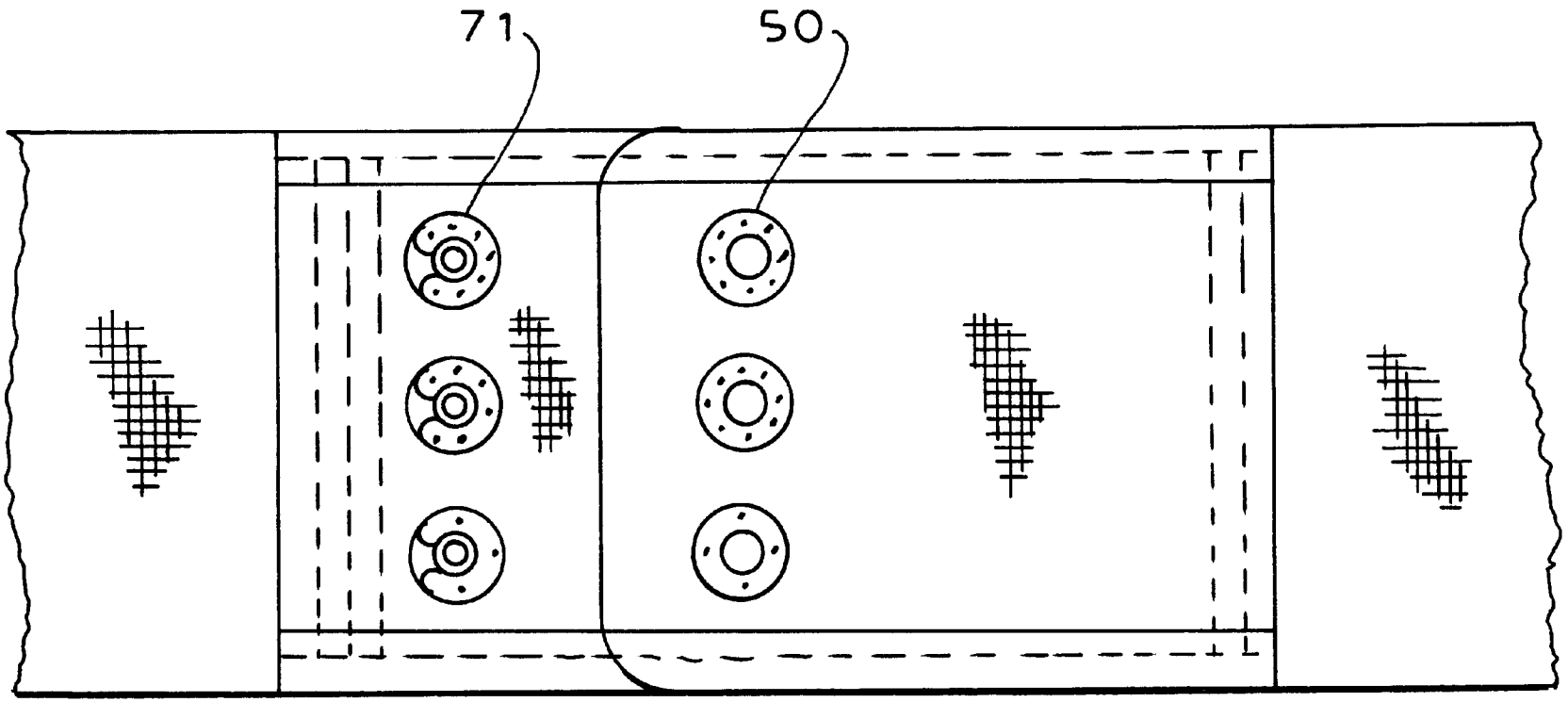
FIG. 31 is a similar view showing the male and female member connected together.

From FIGS. 29–31 it will be apparent that rows 84 of the female members 71 can be provided on the tape 75 which can have rolled edges 85 provided with weld seams 86 holding those rolled edges in place. The welding seams are interrupted at 87 between groups of rows 84 and at which the tape is cut to secure each tape segment with say three rows on a respective brassiere back strap 88 (FIG.>30) for that purpose, after the tape 75 has been cut through in a region between groups of rows, the unseamed edge 87 is opened to receive a tongue of the strap 88 and then closed over that strap, whereupon weld seams 89 are provided to secure the tape to the brassiere strap. Simultaneously, a layer similar to that shown at 70 can be applied to cushion the strap where it contacts the back of the wearer.

Similarly, the row of male members 50 on the tape 68 can be attached to the brassiere strap 90 so that, by lateral insertion, the male members 50 can be inserted into the female members of one or the other row 84 (see FIG. 31).

When the tapes 75, 68 are severed transversely between the rows of male or female members or groups of such rows, the free corners can be rounded as has been shown at 91 and 92 in FIG. 30 to prevent injury to the user by the sharp corners. Thus not only are the tape edges rounded by reason of the rolled over edges 85, but the corners are rounded to prevent injury or snagging of garments.

We claim:

1. A method of making a metal-free strap fastener for articles of clothing including brassieres, lingerie and corsetry, comprising the steps of:

(a) molding onto a first elongated knit web of a thermoplastic yarn, a succession of eyelets to form a female-fastener strip;

(b) enfolding said female-fastener strip in a second elongated web of a thermoplastic yarn so that edge portions of said second web overlie one face of said female-fastener strip alongside said succession of eyelets and another portion of said second web covers the other face of said female-fastener strip;

(c) ultrasonically joining said edge portions to said female-fastener strip and said female-fastener strip to said other portion of said second web at longitudinally spaced-apart intervals along said female-fastener strip at which said eyelets are located to form a fastener band; and (d) ultrasonically severing successive lengths from said band, each of said lengths including at least one of said eyelets whereby said lengths can be affixed to a garment for engagement of a male fastener in the respective eyelet to secure the garment.

2. The method defined in claim 1, further comprising the step of ultrasonically or mechanically piercing said first web to form a succession of holes, said eyelets being molded onto said first web around said holes.

3. The method defined in claim 1 wherein said webs are ultrasonically joined together along an end of the length formed by ultrasonically severing said lengths from said band.

4. The method defined in claim 1 wherein said webs are formed of woven or tricot knit fabrics or a woven tape covered with a tricot fabric tape.

5. The method defined in claim 4 wherein said webs are formed from a polyamide synthetic resin and said eyelets are molded from a polyamide synthetic resin.

6. The method defined in claim 1 wherein between said locations, said edge portions are not bonded to said strip so that, for attachment of said lengths to said garments, a strip of a garment is insertable under said edge portions and said edge portions are then secured to said strip.

7. The method defined in claim 1 wherein said eyelets are molded onto said first web in a succession of spaced-apart groups of at least three eyelets per group.

8. The method defined in claim 1, further comprising the step of inserting a fabric tape between said other portion and said female-fastener strip.

9. The method defined in claim 1 wherein said male fastener comprises a hook molded onto a tape composed of a fabric of thermoplastic yarn.

10. The method defined in claim 9 wherein a succession of said hooks is molded onto the tape of said male fastener and said tape of said male fastener is severed ultrasonically between said hooks into respective male fastener lengths which are secured to said garment, said hooks, said eyelets and said webs and said tape being all composed of polyamide.

11. A method of making a strap fastener for articles of clothing including brassieres, lingerie and corsetry, comprising the steps of:

(a) molding onto a first elongated knit web of a thermoplastic yarn, a succession of synthetic resin coupling members to form a fastener strip;

(b) enfolding said fastener strip in a second elongated knit web of a thermoplastic yarn so that edge portions of said second web overlie one face of said fastener strip alongside said succession of coupling members and another portion of said second web covers the other face of said fastener strip;

(c) ultrasonically joining said edge portions to said fastener strip and said fastener strip to said other portion of said second web at longitudinally spaced-apart intervals along said fastener strip at which said coupling members are located to form a fastener band; and (d) ultrasonically severing successive lengths from said band, each of said lengths including at least one of said coupling members whereby said lengths can be affixed to a garment for engagement of a complementary coupling member in the respective coupling member of the fastener band to secure the garment.

12. The method defined in claim 11 wherein said webs are composed of polyamide woven fabric and said coupling members are composed of polyamide.

* * * * *